United States Patent [19]

Wheatley et al.

[11] Patent Number: 4,489,553

[45] Date of Patent: Dec. 25, 1984

[54] INTRINSICALLY IRREVERSIBLE HEAT ENGINE

[75] Inventors: John C. Wheatley; Gregory W. Swift, both of Los Alamos; Albert Migliori, Santa Fe, all of N. Mex.

[73] Assignee: The United States of America as represented by the United States Department of Energy, Washington, D.C.

[21] Appl. No.: 445,650

[22] Filed: Nov. 30, 1982

Related U.S. Application Data

[63] Continuation-in-part of Ser. No. 292,979, Aug. 14, 1981, Pat. No. 4,398,398.

[51] Int. Cl.[3] ..... F02G 1/00

[52] U.S. Cl. ..... 60/516; 62/6; 62/467

[58] Field of Search ..... 60/516, 517, 650, 669, 60/682, 721; 62/6, 118, 467; 116/DIG. 22, 137 R

[56] References Cited

U.S. PATENT DOCUMENTS 2,836,033 5/1958 Marrison ..... 60/516
3,237,421 3/1966 Gifford ..... 62/6 X

OTHER PUBLICATIONS

Gifford, W. E. and Longsworth, R. C., "Pulse-Tube Refrigeration", *Transactions of the ASME Journal of Engineering for Industry,* Aug. 1964, p. 264.
Gifford, W. E. and Kyanka, G. H., "Reversible Pulse Tube Refrigeration", *Int. Adv. in Cryogenic Engineering,* 12, p. 619, (1966).
Gifford, W. E. and Longsworth, R. C., "Surface Heat Pumping", *Int. Adv. in Cryogenic Engineering,* 11, p. 171, (1965).
Ceperley, P. H., "A Pistonless Stirling Engine-The Traveling Wave Heat Engine", *J. Acoust. Soc. Am.,* 66(5), p. 1508, (1979).
Wheatley, John C., "A Perspective on the History and Future of Low Temperature Refrigeration", *Physica,* vol. 109-110 B&C, pp. 1764-1774, Jul. 1982.
Ackermann, R. A. and Gifford, W. E., "Small Cryogenic Regenerator Performance", *Transaction of the ASME Journal of Engineering Industry,* Feb., p. 274, (1969).
Gifford, W. E. and Longsworth, R. C., "Pulse Tube Refrigeration Process", *Int. Adv. in Cryogenic Engineering,* 10, p. 69, (1965).
Longsworth, R. C., "An Experimental Investigation of Pulse Tube Refrigeration Heat Pumping Rates", *Int. Adv. in Cryogenic Engineering,* 12, p. 608, 1966.
Haselden, G. G., *Cryogenic Fundamentals,* Academic Press, London and New York, 1971, pp. 75-81.
Wood, B. D., *Applications of Thermodynamics,* Addison-Wesley Publishing Company, 1969, pp. 272-285.

*Primary Examiner*—Stephen F. Husar
*Attorney, Agent, or Firm*—William A. Eklund; Paul D. Gaetjens

[57] ABSTRACT

A class of heat engines based on an intrinsically irreversible heat transfer process is disclosed. In a typical embodiment the engine comprises a compressible fluid that is cyclically compressed and expanded while at the same time being driven in reciprocal motion by a positive displacement drive means. A second thermodynamic medium is maintained in imperfect thermal contact with the fluid and bears a broken thermodynamic symmetry with respect to the fluid. the second thermodynamic medium is a structure adapted to have a low fluid flow impedance with respect to the compressible fluid, and which is further adapted to be in only moderate thermal contact with the fluid. In operation, thermal energy is pumped along the second medium due to a phase lag between the cyclical heating and cooling of the fluid and the resulting heat conduction between the fluid and the medium. In a preferred embodiment the engine comprises an acoustical drive and a housing containing a gas which is driven at a resonant frequency so as to be maintained in a standing wave. Operation of the engine at acoustic frequencies improves the power density and coefficient of performance. The second thermodynamic medium can be coupled to suitable heat exchangers to utilize the engine as a simple refrigeration device having no mechanical moving parts. Alternatively, the engine is reversible in function so as to be utilizable as a prime mover by coupling it to suitable sources and sinks of heat.

24 Claims, 11 Drawing Figures

INTRINSICALLY IRREVERSIBLE HEAT ENGINE

This invention is the result of a contract with the U.S. Department of Energy (Contract No. W-7405-ENG-36).

BACKGROUND OF THE INVENTION

This is a continuation-in-part of the parent U.S. patent application Ser. No. 292,979, filed Aug, 14, 1981, now U.S. Pat. No. 4,398,398 and entitled "Acoustical Heat Pumping Engine." The field of this invention relates generally to heat engines, including heat pumps as well as prime movers, and particularly including acoustic heat pumps in which sound is used to produce a heat flow.

The term "heat engine" is used herein in a general sense to denote devices that convert heat into work, i.e. prime movers, as well as devices in which work is performed to produce a heat flow, such as a refrigerator. The latter type of device is referred to herein as a heat pummp. The heat engine of the present invention is described as "intrinsically irreversible" because it utilizes certain heat transfer processes which are intrinsically irreversible in the thermodynamic sense. In contrast with a conventional heat engine, which approaches an optimum level of efficiency as its heat transfer processes are conducted in an increasingly reversible manner, the intrinsically irreversible heat engine of the present invention requires as an essential element for its operation an irreversible heat transfer process, and the efficiency of the engine in fate decreases as the heat transfer process departs from an irreversible process. These characteristics of the invention are discussed further below.

The present invention is related to a phenomenon studied as early as the 1850's by the European physicists Sondhauss and Rijke, in which sound is produced by heating one end of a glass or metal tube. This and similar phenomena were discussed as early as 1878 by Lord Rayleigh in his treatise entitled *Theory of Sound.* In these phenomena heat is used to produce work in the form of sound. More recently, complementary phenomena based on similar principles have been demonstrated, in which work is expended and heat is pumped from one place to another. In contrast with the general thermodynamic principles of conventional heat engines, which have been well understood for over a century, the principles underlying the above phenomena and the extent or generality of related phenomena are presently only imperfectly understood.

A heat pumping phenomenon related to that considered here is reported in a paper by W. E. Gifford and R. C. Longsworth, entitled "Surface Heat Pumping", published in *International Advances in Cryogenic Engineering* (Plenum Press, NY), Vol. 12, p. 171–179 (1965). The heat pumping phenomenon reported by Gifford and Longsworth has been utilized in a heat pumping device known as a pulse tube refrigerator. Such a device is described in a series of papers by Gifford and others, the most pertinent of which are: Gifford, W. E. and Longsworth, R. C., "Pulse Tube Refrigerator," Trans. of the A.S.M.E., J. of Eng. for Industry, P. 264–68 (1964); Gifford, W. E. and Longsworth, R. C., "Pulse Tube Refrigeration Process," in *International Advances in Cryogenic Engineering* (Plenum Press, N.Y.) Vol. 10, p. 69–79 (1964); and Gifford, W. E. and Kyanka, G. H., "Reversible Pulse Tube Refrigeration," in *International Advances in Cryogenic Engineering,* Vol. 12, p. 619–630 (1966). Another related paper is by R. C. Longsworth, entitled "An Experimental Investigation of Pulse Tube Refrigeration Heat Pumping Rates," in *International Advances in Cryogenic Engineering,* Vol. 12, p. 608–18 (1966). All of the foregoing papers are directed to a pulse tube refrigerator in which a gas is alternately pumped into and evacuated from a hollow pulse tube through a thermal regenerator. The result is that heat is pumped from the regenerator end of the pulse tube to the closed end. Heat exchangers are coupled to the ends of the tube to take advantage of this effect. For example, if the warm end is connected to a heat sink at ambient temperature, the cool end can be utilized as a refrigerator. It will be recognized that the pulse tube refrigeration device differs from conventional refrigeration apparatus in that there is only a single volume of gas which is periodically pressurized in a closed chamber, and that there is eliminated much of the valving, throttling and other plumbing associated with conventional refrigeration apparatus. As will be apparent from the discussion below, the applicants have developed a related class of devices which have some of the same characteristics, but which do not require the use of an external thermal regenerator.

Another prior art device that is of particular interest with respect to a particular embodiment of the present invention is a traveling wave heat engine, described in U.S. Pat. No. 4,114,380 to Ceperley and in P. H. Ceperley, "A Pistonless Stirling Engine-the Traveling Wave Heat Engine," J. Acoust. Soc. Am. 66, 1508 (1979). This device utilizes a compressible fluid in a tubular housing and an acoustic traveling wave. The housing contains a differentially heated thermal regenerator. Heat is added to the fluid on one side of the regenerator and is extracted from the fluid on the other side of the regenerator. The regenerator has a large effective heat capacity compared with that of the fluid so that it can receive and reject heat without a large temperature change. The material between the two ends of the regenerator is retained in local thermal equilibrium with the fluid, thereby causing a temperature gradient in the fluid to remain essentially stationary. The operation of this device is different from that of the instant invention in several respects. The Ceperley device uses traveling acoustic waves for which the local oscillating pressure P is necessarily equal to the product of the acoustic impedance $\rho c$ (where $\rho$ is the density and c is the velocity of sound in the gas) and the local fluid velocity v at every point of the engine thereby increasing viscous losses to extremely large values, whereas, as discussed further below, an acoustic embodiment of the instant invention uses standing acoustic waves for which the condition $p >> \rho cv$ can be achieved, thereby enhancing the ratio of thermodynamic to viscously dissipative effects. Traveling waves require that no reflections occur in the system. Such a condition is difficult to achieve because the thermal regenerator acts as an obstacle which tends to reflect the waves. Additionally, a thermodynamically efficient pure traveling wave system is more difficult to achieve technically than a standing wave system. The Ceperley device also requires that the primary fluid be in excellent local thermal equilibrium with the regenerator. This has the effect of making it closely analogous to a Stirling engine. However, the requirement on the fluid geometry necessary to give good thermal equilibrium together with the requirement that $P=\rho cv$ for a traveling wave necessarily results in a large viscous loss (except in fluids of both exceedingly low Prandtl number and high thermodynamic activity, which are unknown). As discussed below, the present invention utilizes imperfect thermal contact with a second medium as an essential element of the heat pumping process. As a consequence, an engine made in accordance with the present invention need not necessarily have the high viscous losses of the Ceperley traveling wave engine.

U.S. Pat. No. 3,237,421 to Gifford describes the heat pumping device discussed in the previously cited articles by Gifford et al. As already noted, the present invention differs from the Gifford device primarily in that the regenerator required in the Gifford device between the pressure source and the pulse tube of the device is not needed in the present invention; and that in the Gifford device the useful thermodynamic effect occurs in the open, or "pulse" tube whereas in the present invention the useful thermodynamic effect occurs in a second medium. Including a regenerator in the present invention would degrade its performance as a consequence of the same viscous heating problems that characterize the Ceperley device. Further, the Gifford device requires moving seals while some embodiments of the present invention do not. Also, heat transfer rates in the Gifford device restrict its operation to low frequencies and hence it cannot achieve the high power densities possible with the present invention.

SUMMARY OF THE INVENTION

Accordingly, it is an object and purpose of the present invention to provide a heat engine which is based on an intrinsically irreversible heat transfer process. In this regard, it is an object to provide such an engine which, while based on an irreversible heat transfer process, is functionally reversible in the sense that it is operable either as a heat pump or as a prime mover.

It is also an object of the invention to provide an acoustically driven heat pump.

Another object of the invention is to provide a heat engine having no moving seals.

It is also an object of the invention to eliminate the need for external mechanical inertial devices such as fly-wheels or compressors in a heat pump, particularly a heat pump adapted for use as a refrigerator.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purposes of the present invention as embodied and broadly described herein, the intrinsically irreversible heat engine of the present invention comprises a first thermodynamic medium and a second thermodynamic medium, which are in imperfect thermal contact with one another and which bear a broken thermodynamic symmetry with respect to one another.

The first medium is movable in a reciprocal manner with respect to the second medium. Further, the reciprocal motion of the first medium causes or is attended by a temperature change to occur in the first medium, such that the temperature of the first medium varies as a function of its position.

By stating that the first and second mediums bear a broken thermodynamic symmetry with respect to one another, it is meant that the average heat flow per unit length between the two mediums, taken in a direction perpendicular to the path of reciprocal motion of the first medium with respect to the second medium, increases along the path of reciprocal motion in a first region and decreases along the path of reciprocal motion in a second region. If this average heat flow per unit length is constant we say there is thermodynamic symmetry, if not, we say the thermodynamic symmetry is broken. In a common application, broken thermodynamic symmetry is achieved by imposing a discontinuous or rapidly changing thermal conductance per unit length between the first and second mediums.

The engine is functionally reversible in practical application in the sense that it may be employed either as a heat pump or as a prime mover.

When employed as a heat pump, the engine includes a drive means for effecting the reciprocal motion of the first medium relative to the second medium at a frequency which is approximately inversely related to the thermal relaxation time of the first medium with respect to the second medium. Such reciprocal motion, together with the cyclical variation in the pressure and temperature of the first medium, results in the generation of a temperature difference, or a temperature gradient, in the second medium. More specifically, the second medium becomes relatively warmer in those regions where the average heat flow per unit length between the two mediums decreases in the direction of the component of reciprocal motion of the first medium that is attended by an increase in the temperature of the first medium. Conversely, the second medium becomes relatively cooler in those regions where the average heat flow per unit length between the two mediums increases in the direction in which the first medium is heated. In a typical heat pump application the second medium is constructed such that its surface area per unit length increases abruptly at one point and decreases abruptly at another point. At these points pronounced cooling and heating effects occur in the second medium. These effects can be utilized by connecting the second medium to suitable heat exchangers. For example, if the portion of the second medium that undergoes heating is connected to a heat sink, the portion that undergoes relative cooling may be utilized as a refrigeration device.

The heat engine may be utilized as a prime mover by selectively heating and cooling portions of the second medium so as to produce a differential temperature distribution in the second medium which is the opposite of that obtained when the engine is utilized as a heat pump. When so heated, the first medium may be driven in reciprocal motion at a frequency which is determined by the geometry of the device, the mechanical load on the device, and the thermal relaxation time of the first medium to the second medium.

Gifford and Longsworth have described the processes which occur in their devices in terms of a concept called "surface heat pumping." The word "surface" here implies the existence of both a secondary as well as a primary medium contiguous with one another, the secondary medium being the fundamental quality introduced into heat engines by Robert Stirling in his 1816 patent. As the present intrinsically irreversible engines have qualities additional to those of Stirling's engine and can be used not only to pump heat but also to perform external work we prefer to describe the present engines in terms of the more appropriate, and new, concept of broken thermodynamic symmetry.

In a typical embodiment of the invention the first thermodynamic medium is a gas and the second thermodynamic medium is a solid material. A simple way to break the thermodynamic symmetry between such mediums is to construct the second medium such that there is an abrupt change (increase or decrease) in the amount of second medium in contact with the first medium along the axis of motion of the first medium. At this point a thermodynamic effect will occur, the sign of the effect (heating or cooling) depending on whether the amount of second medium in contact with first medium decreases or increases in the direction in which the first medium increases in temperature in its reciprocal motion.

In its simplest form, a heat pump constructed in accordance with the present invention comprises a closed cylinder containing a gas; drive means for alternately compressing and expanding the gas from one end of the cylinder, such as a simple reciprocating piston or, alternatively, an acoustic driver; and a second thermodynamic medium (the gas being the "first" thermodynamic medium) located within the cylinder. The second thermodynamic medium has structural characteristics which are in some respects similar to those of a thermal regenerator. In one embodiment, for example, the second thermodynamic medium consists of a set of parallel plates spaced from one another and extending parallel to the longitudinal axis of the cylinder. In another embodiment the second thermodynamic medium consists of a set of mesh screens spaced apart along the axis of the cylinder. Although either of these structures might function as a thermal regenerator in another application, applicants have discovered that when such a structure is utilized in the apparatus of the present invention there results in a heat pumping effect which, in contrast to the function of a regenerator, requires imperfect thermal contact between the gas and the adjacent solid medium.

The second thermodynamic medium may be generally defined as a medium having a low impedance to fluid flow; a high thermal resistance in the longitudinal direction, or direction of fluid flow; a high surface area-to-volume ratio; and, for purposes of forming an efficient heat engine, having an adequately large combination of specific heat and thermal conductivity to enable it to absorb heat from or reject heat to the primary medium as required. The latter requirement is met by virtually all solid materials when the primary medium is a gas and the operating temperatures are not too low.

The applicants have discovered that, when the above prerequisites are met, the second thermodynamic medium undergoes a pronounced heating at its end distant from the drive means and undergoes a pronounced cooling at its end closest to the drive means. This effect is obtained regardless of where along the cylinder the second thermodynamic medium is located (as long as the length of the apparatus is less than one quarter wavelength), although the size of the effect increases with increasing distance between the closed end and the region where the thermodynamic symmetry is broken. Moreover, the effect is obtained even where the length of the second thermodynamic medium is substantially less than that portion of the length of the cylinder which represents the minimum volume of the fluid in each cycle.

The heating and cooling effects observed at the opposite ends of the second thermodynamic medium can be utilized by thermally coupling the ends of the second thermodynamic medium to suitable heat exchangers. For example, the warm end of the second thermodynamic medium can be coupled to any suitable heat sink so as to utilize the cool end as a refrigeration device.

The applicants have also discovered that the efficiency of the device with respect to heat transfer to and from thermal reservoirs can be further enhanced by constructing the second thermodynamic medium of two different materials. A first material which has a high thermal conductivity, for example copper, is employed at the opposite ends of the second medium. This material is used to obtain maximum heat transfer in transverse directions between the ends of the medium and the adjacent cylinder walls and heat exchanger means. A second material is used to construct the medium between the opposite ends. This second material is selected so as to have a much lower thermal conductivity than the first material, thereby minimizing lengthwise conduction of heat along the medium from the hot end to the cold end. It is also important that the heat capacity, thermal conductivity product of the second medium be larger than that for the gas. In the simple embodiment thus far described, fiberglass or polymeric strips are suitable examples. Such a material acts to absorb heat from and release heat to the fluid during each cycle, thereby facilitating the overall energy transfer. A similar process has been described by Gifford and Longsworth in *International Advances in Cryogenic Engineering,* Vol. 11, p. 171 (1965), also cited above.

In accordance with one explanation of this phenomenon based on articulated motions of the pistons, consider an incremental volume of gas which is compressed and driven toward the closed end of the cylinder during each compressional stroke of the piston. The movement is rapid and the gas is compressed nearly adiabatically, thus raising its temperature. At the end of the compression stroke there is a pause, during which the heated increment of gas transfers heat to the immediately adjacent surface of the second thermodynamic medium, thus raising the temperature of the medium at that point. In the next step in the cycle, the increment of gas is rapidly expanded, approximately adiabatically, and in so doing the gas travels down the cylinder toward the piston, cooling to a lower temperature. At the end of the stroke there is once again a pause, during which the increment of gas absorbs heat from the surface of the immediately adjacent thermodynamic medium and thereby cools it. This ends one full cycle of the engine. It will be seen that, in the manner just described, heat has been transferred from one point in the medium to another point in the medium closer to the closed end of the cylinder. All increments of fluid within the second thermodynamic medium undergo the same type of cycle, so that the net result is to transfer heat from one end of the medium to the other end. Within the region of the second medium there may be a small net heating at all points, but at the ends of the medium, where the thermodynamic symmetry is broken, there are net heat transfer effects which result in pronounced heating and cooling effects. At the end closest to the closed end of the cylinder, heat is added so as to raise the temperature of the second medium, and at the opposite end the medium is cooled.

The frequency at which the device is operated is an important factor which affects the coefficient of performance, or efficiency, of the device in pumping heat. This can be most simply explained by comparing the heat transfer process described above with what happens at either very high or very low frequencies. If the frequency of pressurization is sufficiently low, expansion and compression of the fluid occur slowly and approximately isothermally with respect to the second thermodynamic medium, rather than adiabatically. For example, if the pressurization stage of the cycle is conducted slowly, heat is continuously transferred to the walls of the cylinder as the fluid is compressed and driven down the cylinder. At the end of the compression stroke the temperature of the fluid is no higher than that of the adjacent cylinder wall, and no heat transfer occurs at this point in the cycle. During the subsequent expansion of the fluid in the next stage of the cycle, the fluid progressively cools as it travels along the medium, and continuously extracts exactly the same amount of heat as was delivered in the previous stage. The important feature of this hypothetical very slow cycle is that the fluid is always in thermal equilibrium with the walls of the second medium. If the frequency is sufficiently high, there is insufficient time at the end of each stroke of the piston for measureable heat transfer to occur between the fluid and the cylinder walls. However, if the frequency is between these isothermal and adiabatic extremes, expansion as well as compression of the fluid occurs with some heat transfer between the fluid and the cylinder walls, and the heat pumping process described above can take place. Thus, the coefficient of performance of the device diminishes at both high frequencies and low frequencies. At some intermediate frequency there is an optimum coefficient of performance for any given device.

One effect of utilizing the second thermodynamic medium of the type described above is that the frequency at which the optimum coefficient of performance occurs is much higher than can be obtained with a pulse-tube refrigeration device having no such second thermodynamic medium. In fact, this discovery has enabled the applicants to develop an efficient heat pumping engine which operates at acoustic frequencies. One primary advantage of such an engine is that a very simple electrically driven acoustical driver can be used to drive the engine, thus eliminating the mechanical problems associated with reciprocating pistons, crankshafts, moving fluid seals, flywheels and so on. Another primary advantage of operating at high frequencies is that the power density of the device can be increased in almost direct proportion to the operating frequency, thus making possible a compact heat pumping or refrigeration device having greater power density and coefficient of performance than previously known similar devices.

Since the applicants' invention is based on processes which are explained only in terms of nonequilibrium thermodynamics, the heat engine is intrinsically irreversible in the thermodynamic sense. At the same time, however, the invention is functionally reversible in practical application, in that a device built in accordance with the invention may be mechanically driven so as to function as a heat pump, or it may be coupled to sources of heat and cold to function as a prime mover.

In accordance with a particular aspect of the invention adverted to above, there is provided an acoustical heat pumping engine comprising a tubular housing, such as a straight, U- or J-shaped tubular housing. One end of the housing is capped and the housing is filled with a compressible fluid capable of supporting an acoustical standing wave. The other end is closed with a device such as the diaphragm and voice coil of an acoustical driver for generating an acoustical wave within the fluid medium. In a preferred embodiment a device such as a pressure tank is utilized to provide a selected pressure to the fluid within the housing. A second thermodynamic medium is disposed within the housing near, but spaced from, the capped end to receive heat from the fluid moved therethrough during the time of increasing pressure of a wave cycle and to give up heat to the fluid as the pressure of the gas decreases during the appropriate part of the wave cycle. The imperfect thermal contact between the fluid and the second medium results in a phase lag different from 90° between the local fluid temperature and its local velocity. As a consequence there is a temperature differential across the length of the medium and in the case of the preferred embodiment essentially across the length of the shorter stem of the J-shaped housing. Heat sinks and/or heat sources can be incorporated for use with the device of the invention as appropriate for refrigerating and/or heating uses.

BRIEF DESCRIPTION OF THE DRAWINGS

The accompanying drawings, which are incorporated in and form a part of the specification, illustrate several embodiments of the invention and, together with the description, serve to explain the principles of the invention. In the drawings.

DETAILED DESCRIPTION OF THE INVENTION

Figure 1:
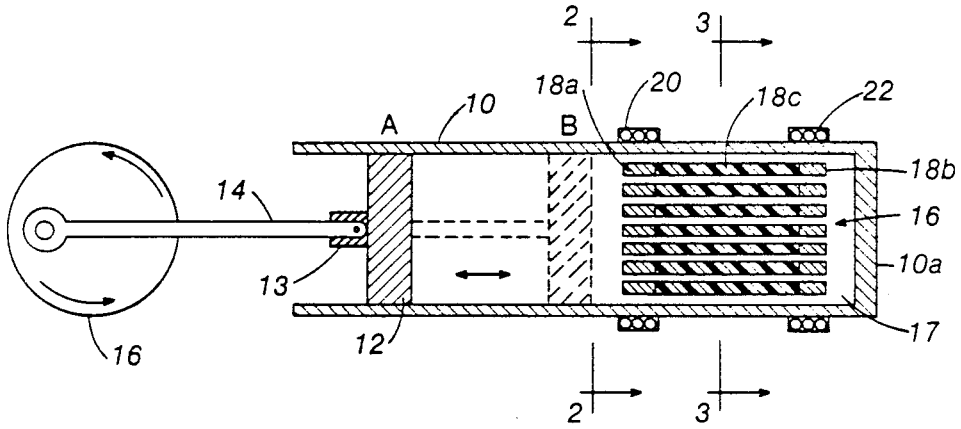
FIG. 1 is a side view in cross section of a simple preferred embodiment of the invention.
Figure 2:
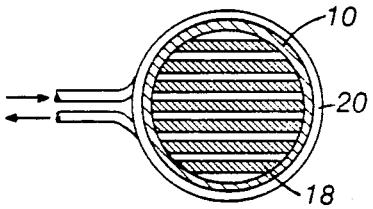
FIG. 2 is an end view in cross section of the embodiment of FIG. 1, taken along section line 2—2 of FIG. 1.
Figure 3:
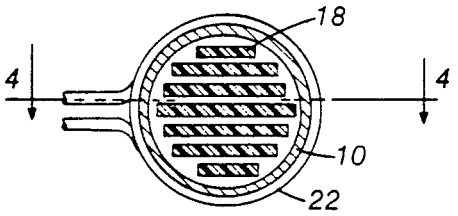
FIG. 3 is an end view in cross section of the embodiment of FIG. 1, taken along section line 3—3 of FIG. 1.
Figure 4:
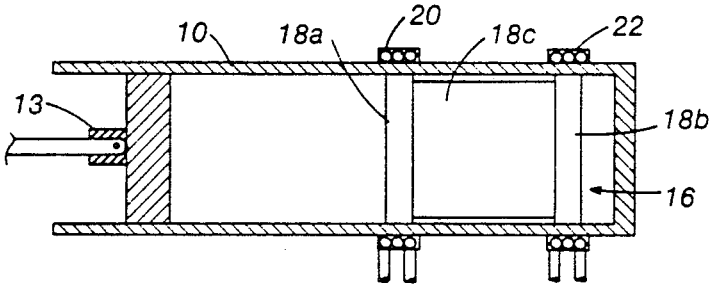
FIG. 4 is a plan view in cross section of the embodiment shown in FIG. 1, taken along section line 4—4 of FIG. 3.

FIGS. 1-4 illustrate schematically a simple embodiment of a heat pump constructed in accordance with the present invention.

The heat pump comprises a cylindrical casing 10 having a closed end 10*a* and having a piston 12 slidably positioned in its open end. The piston 12 is connected through a wrist pin 13 by a rod 14 to a crankshaft 16. The crankshaft is connected to any suitable source of mechanical power so as to drive the piston 12 in reciprocal motion within the cylinder casing 10.

The cylinder 10 contains a gas, for example, helium, which constitutes a first thermodynamic medium and which is alternately compressed and expanded by the reciprocal motion of the piston 12.

The piston 12 moves in reciprocal motion between positions A and B, illustrated in FIG. 1. When the piston 12 is at position A, the gas is at its maximum volume, and when the piston 12 is at position B, the gas is compressed to its minimum volume and maximum pressure.

A second thermodynamic medium 16 is located inside the cylinder casing 10 adjacent the closed end 10*a*. The second medium 16 consists of a set of parallel, spaced plates 18. Each plate 18 is generally rectangular in configuration and extends longitudinally within the cylinder casing 10 from a point adjacent the closed end 10*a* to a point just short of the position B which represents the position of maximum displacement of the piston 12. The thickness of each of the plates 18 is exaggerated in the Figures for purposes of illustration.

Each plate 18 consists of three parts: copper end sections 18*a* and 18*b*, and a fiberglass intermediate section 18*c*. The end sections 18*a* and 18*b* extend completely across the cylinder casing 10 and are fused to the walls of the cylinder casing 10 to enhance conduction of heat between the casing 10 and the end sections. Each fiberglass intermediate section 18*c* is of a relatively smaller width than the respective corresponding end sections 18*a* and 18*b*, such that the edges of each intermediate section 18*c* are spaced from the walls of the cylinder casing 10.

The heat engine of FIGS. 1–4 further includes heat exchangers 20 and 22 which encircle the cylinder casing 10 adjacent the end sections 18*a* and 18*b* of the second thermodynamic medium 16. Heat exchanger 20 is designated the cold heat exchanger, and heat exchanger 22 is designated the hot heat exchanger, for reasons which will become apparent below.

In operation, the piston 12 is driven by the crankshaft 16 in reciprocating motion so as to alternately compress and expand the gas contained in the cylinder 10. As a result of such operation the end sections 18*a* of the second thermodynamic medium become cold and the end sections 18*b* become hot relative to their common ambient starting temperature. To operate the device as a refrigerator, therefore, the hot heat exchanger 22 can be cooled by any suitable means, for example by circulation of tap water, so as to draw away the heat accumulated at the end sections 18*b* and thereby result in relative cooling of the end sections 18*a* and the associated cold heat exchanger 20 well below the ambient starting temperature.

It is the reciprocal motion of the gas, coupled with the alternating compression and expansion of the gas, the imperfect thermal contact and the broken thermodynamic symmetry between the gas and the second thermodynamic medium, that gives rise to the heat flow along the second thermodynamic medium. The effect is obtained regardless of the means used to drive the gas. The drive means may be a mechanical device, such as the piston in the simple embodiment described above. However, electromagnetic drivers operating at acoustic frequencies have been found to be particularly useful, as they can be employed to produce a device having no external moving parts and no fluid-tight moving seals. Additionally, such drivers result in higher power densities and greater coefficients of performance.

Figure 5:
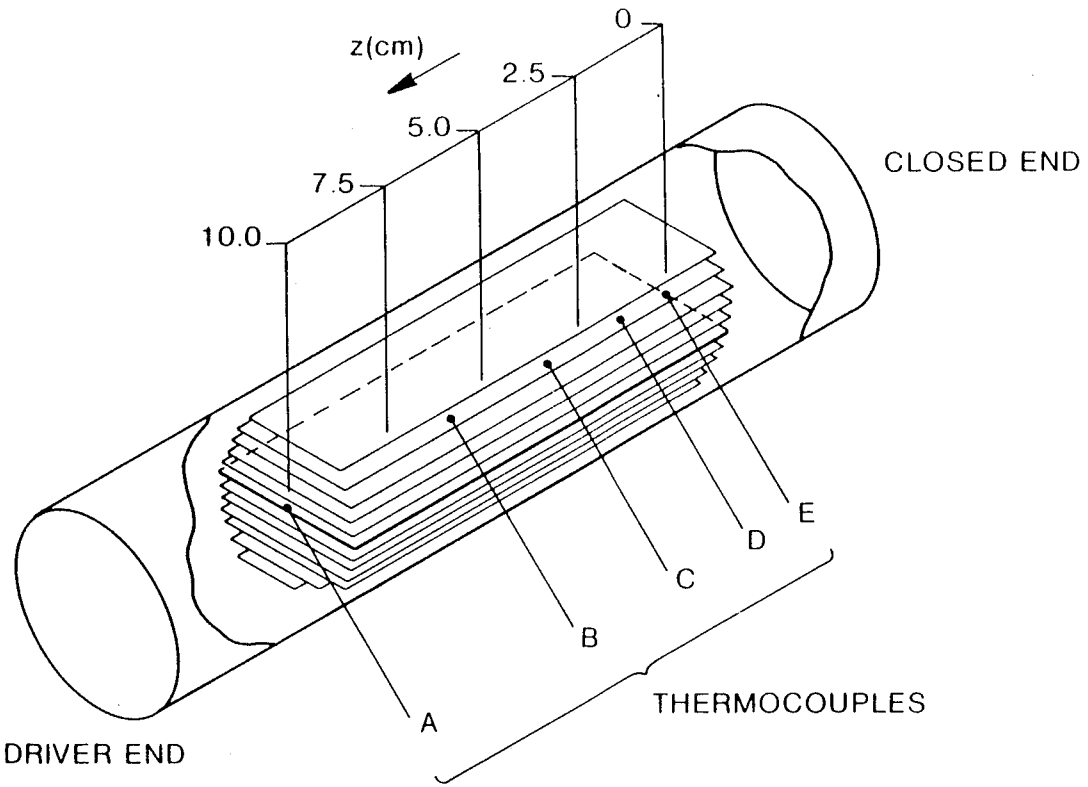
FIG. 5 is an isometric view of a test device provided with thermocouples A through E placed along a center plate of the second thermodynamic medium.

FIG. 5 illustrates a simple demonstration device that is approximately 10 centimeters long and which is fitted with a set of five thermocouples (A through E) positioned along the central plate of the second thermodynamic medium. The plates are formed of fiberglass impregnated with polyester resin. The device was filled with helium to a pressure of approximately 5 atm, and was driven by an acoustical driver (not shown) at a frequency of 400 cycles per second.

Figure 6:
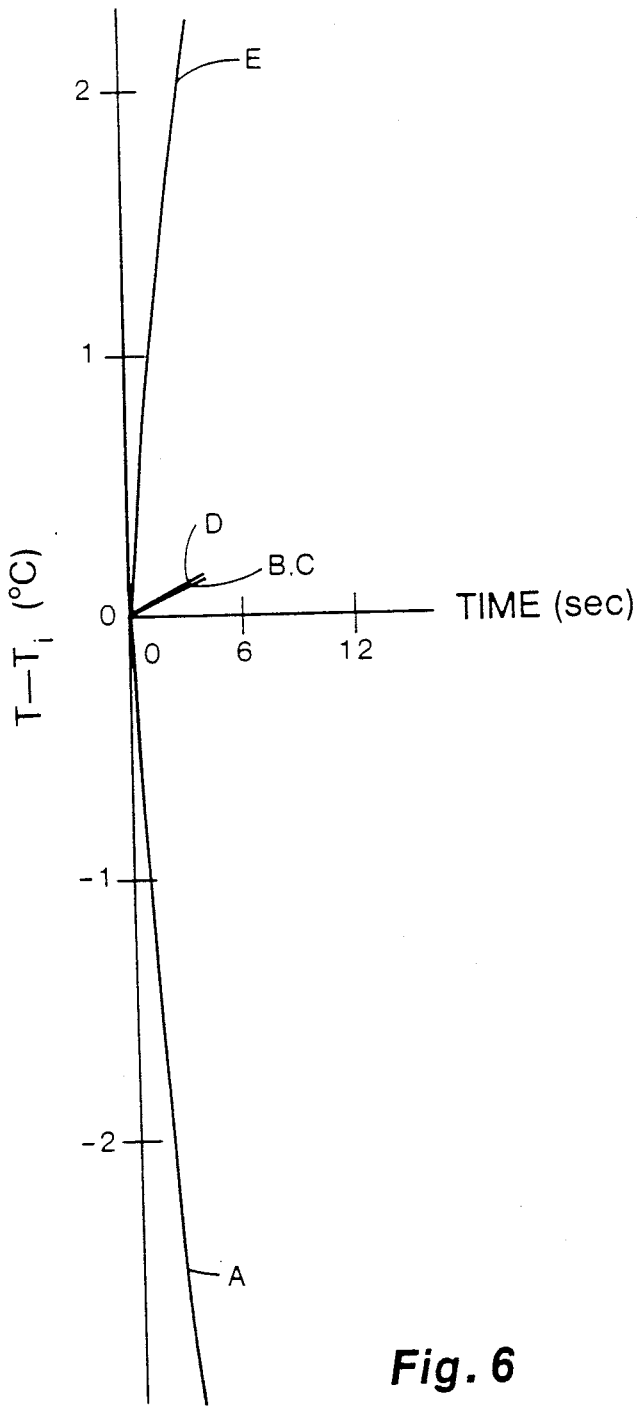
FIG. 6 is a plot of temperature versus time for the five thermocouples of FIG. 5.

FIG. 6 shows the response of the device of FIG. 5 during the first few seconds after the acoustical driver was actuated. In this Figure the temperature of each thermocouple is represented as the difference between its instantaneous temperature T and its initial temperature Ti. The initial temperature Ti was the same for each thermocouple and was the ambient room temperature at the time of the demonstration. It will be seen that the thermocouples A and E, which are located at the opposite ends of the plates comprising the second thermodynamic medium, undergo immediate and substantial temperature changes in opposite directions from their common initial starting temperature Ti. The intermediate thermocouples B, C and D undergo less pronounced temperature changes.

Figure 7:
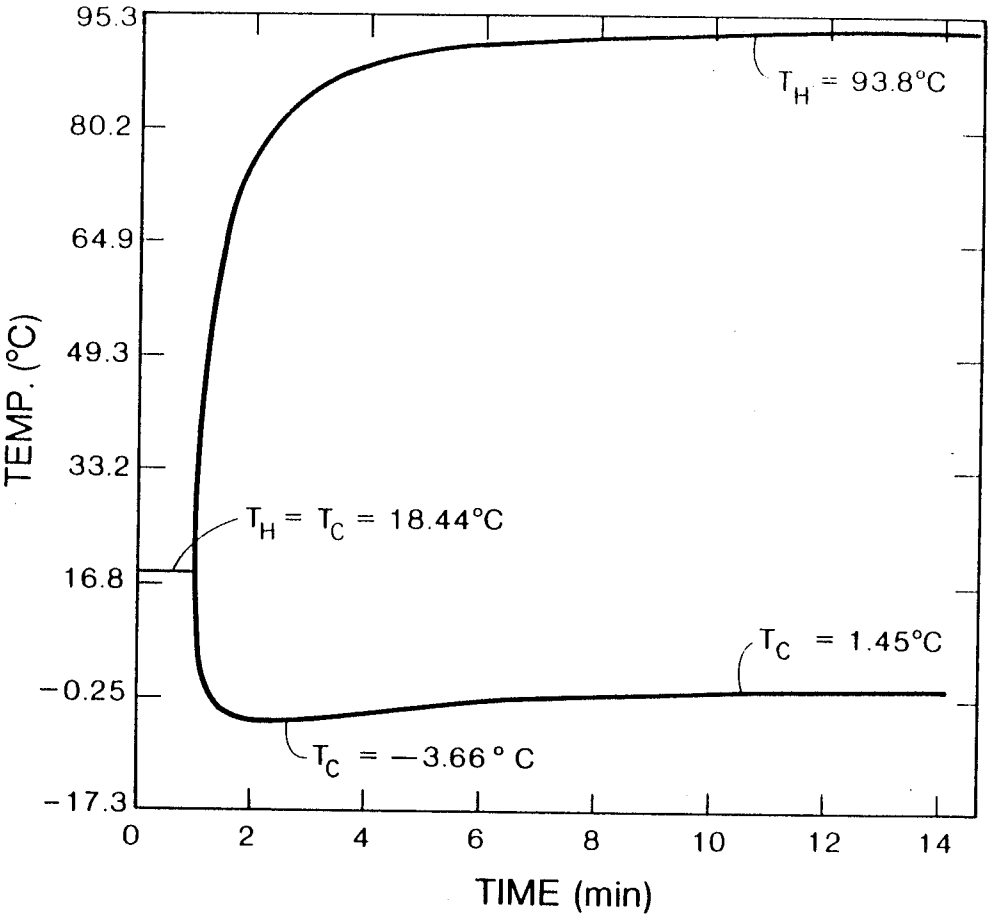
FIG. 7 is a plot of temperature versus time for a pair of thermocouples positioned at the opposite ends of a test device similar to that shown in FIG. 5.

FIG. 7 sets forth actual test results over a longer period of time. The test results presented in FIG. 7 were obtained with another similar embodiment consisting of 19 parallel fiberglass plates positioned in an inconel tube having an inside diameter of 2.81 cm. The inconel tube was straight, horizontal and uninsulated. The plates were each 10 cm long, 0.0125 cm thick and were spaced apart by 0.094 cm. The widths of the plates varied in the manner illustrated in FIG. 5. The ends of the plates closest to the closed end of the tube were positioned at a distance of 6 cm from the closed end. The tube was filled with helium to a pressure of 1.903 atmospheres and was driven by an acoustic driver at a frequency of 268 Hz. A pair of thermocouples were located at the opposite ends of the center plate. The temperatures recorded by the two thermocouples as a function of time are indicated by the two curves in FIG. 7.

The plates and the surrounding gas were allowed to equilibrate at room temperature for a period of time prior to actuation of the acoustic driver. This period is indicated by the initial portions of the curves over the time interval of 0 to 1 minute. During this interval the two curves are flat and superimposed on one another at the room temperature of 18.44° C. After thermal equilibrium was established, the acoustic driver was turned on at a time represented by Time=1 minute. As indicated by the plots, the thermocouples registered immediate temperature changes within a period of seconds. The thermocouple at the cold end of the plates reached a minimum temperature of approximately −3.7° C. after about one minute, and thereafter warmed slightly to a temperature of approximately 1.4° C. over a period of about 14 minutes. The thermocouple at the hot end warmed rapidly over a period of several minutes and eventually reached a steady temperature of about 93.8° C.

The operation of the engine can be explained by analyzing the energy flow within the cylinder of a simple embodiment such as the test device of FIG. 5. For the purpose of clarity of explanation we will neglect the effect of viscosity. First, consider an empty cylinder wherein a compressible gas is subjected to compression from one end, for example by a piston, and in the process is driven down the cylinder. For a cylinder of cross-sectional area A, the incremental volume of gas dV passing any fixed point on the cylinder is given by the equation:

$$dV = Avdt \quad (1),$$

where v is the instantaneous velocity of the gas at the fixed point and t is time. The mass of the incremental volume of gas passing the fixed point is given by:

$$dm = \rho dV \quad (2),$$

where $\rho$ is the density of the gas. Substituting equation (1) into (2) gives:

$$dm = \rho Avdt \quad (3).$$

The incremental amount of energy flowing past the fixed point in time dt is the sum of the internal energy of the incremental mass of gas dm and the work done by the gas dm. This is represented by the equation:

$$dE = udm + PdV \quad (4),$$

where u is the internal energy per unit mass, or specific internal energy, of the gas; and P is the pressure of the gas in the cylinder. The above equation can be written also as:

$$dE = (u + P\nu)dm \quad (5),$$

where $\nu$ is the specific volume, or volume per unit mass $(1/\rho)$, of the gas.

For a monatomic gas such as helium, the molar internal energy U is given by the equation $$U = (3/2)RT \quad (6).$$

The specific internal energy u is thus given by the equation:

$$u = \frac{(3/2)RT}{M.W.}, \quad (7)$$

where M.W. is the molecular weight of the gas.

From classical thermodynamics we have the equation for molar enthalpy H (with $V_m$ molar volume):

$$H = U + PV_m \quad (8).$$

The specific enthalpy h is thus given by:

$$h = u + P\nu \quad (9),$$

and from equation (5) we thus have:

$$dE = hdm \quad (10).$$

Substituting the expression for dm in equation (3) into the above equation gives:

$$dE = h\rho Avdt \quad (11).$$

The rate of energy flow across the fixed point in the cylinder can thus be defined as $\dot{H}$ and written as:

$$\dot{H} = \frac{dE}{dt} = h\rho Av. \quad (12)$$

From equations (7) and (9) above we can represent h by the equation:

$$h = u + p\nu = \frac{(3/2)RT}{M.W.} + p\nu. \quad (13)$$

By introducing the ideal gas law PV=nRT we can rewrite the above equation (13) as $$h = \frac{(3/2)RT}{M.W.} + \frac{RT}{M.W.} = \frac{(5/2)RT}{M.W.}. \quad (14)$$

Equation (12) can thus be rewritten, by introducing the above equation for h, as:

$$\dot{H} = \frac{(5/2)RT\rho Av}{M.W.}. \quad (15)$$

From thermodynamics we have the expression for the specific heat capacity of a gas at constant pressure, $C_p$, which is given as:

$$C_p = \frac{dh}{dT}. \quad (16)$$

From equation (14) we can represent equation (16) for $C_p$ as:

$$C_p = \frac{(5/2)R}{M.W.}. \quad (17)$$

Thus, equation (15) can be rewritten as:

$$\dot{H} = \rho C_p TAV \quad (18).$$

For a gas that undergoes a temperature change $\delta T$ from a mean temperature $\overline{T}$, such that $T = \overline{T} + \delta T = \overline{T} + T_a \cos \omega t$, where the last form is appropriate for the gas far from the walls of the vessel, there is a corresponding enthalpy change $\delta h$ which can be written as:

$$\bar{h} = h + \delta h \quad (19).$$

Representing this equation in terms of equation (14) gives:

$$h = \frac{(5/2)R\overline{T}}{M.W.} + \frac{(5/2)R\delta T}{M.W.}. \quad (20)$$

Substituting equation (17) into (20) above gives:

$$h = C_p\overline{T} + C_p\delta T \quad (21).$$

Now consider the time-averaged rate of energy flow, which is represented by $\bar{\dot{H}}$. This quantity can be represented by taking the time average of equation (12), as follows:

$$\bar{\dot{H}} = \overline{\rho hAv} = \overline{\rho(\bar{h} + \delta h)Av} \quad (22)$$

-continued $$= \overline{\rho h A v} + \overline{\rho \delta h A v} .$$

If the gas is oscillating in a reciprocal manner, then the time-averaged velocity $\bar{v}$ is equal to zero and the term $\overline{phAv}$ in equation (22) equals zero, the other variables being constants, such that:

$$\bar{\dot{H}} = \overline{\rho \delta h A v} \quad (23).$$

Substituting the expression for δh in equation (21) into the above equation gives:

$$\bar{\dot{H}} = \overline{\rho C_p \delta T A V} \quad (24).$$

Assuming the gas is oscillating in a sinusoidal reciprocating manner, the pressure P will vary by an amount δP about an average pressure $\bar{P}$ in a manner given by:

$$P = \bar{P} + \delta P = \bar{P} + P_a \cos \omega t \quad (25),$$

where the phase of the oscillating pressure is taken to be the same as the phase of the oscillating temperature far from the walls. If the expansion and compression of the gas is adiabatic, then δP can be shown to be related to the temperature change far from the walls by the equation:

$$\delta P = P_a \cos \omega t = \rho C_p \delta T \quad (26).$$

The gas also undergoes a reciprocal displacement at every point, which in the absence of viscosity is given by:

$$x = x_a \cos \omega t \quad (27),$$

where x is the instantaneous displacement from an average initial position and $x_a$ is the maximum displacement in either direction from that position. Thus the parameters x, δP and δT far from the walls of the vessel vary in phase with one another.

The velocity v of the gas at any point is given by:

$$v = \frac{dx}{dt} = -\omega x_a \sin \omega t. \quad (28)$$

Recalling now that $\bar{\dot{H}} = \overline{\rho C_p \delta T v A}$ (Equation (24)), equations (26) and (28) above can be inserted into (24) to give:

$$\bar{\dot{H}} = \overline{(P_a \cos \omega t)(-\omega X_a \sin \omega t)(A)} \quad (29).$$

Since $\overline{(\sin \omega t)(\cos \omega t)} = (\frac{1}{2})\ \overline{\sin 2\omega t}$, the above equation reduces to $$\bar{\dot{H}} = \overline{(\tfrac{1}{2}) P_a X_a \omega A \sin 2107\, t} \quad (30),$$

and since the time average of the sine function is zero, the result is that $\bar{\dot{H}} = 0$. Hence there is no net flow of energy in the reciprocating gas in a cylinder whose walls have no thermal effect.

If a plate at temperature $\bar{T}$ oriented parallel to the direction of gas motion is introduced into the cylinder (normal to the plate perpendicular to the cylinder axis), the situation changes. Next to the plate there will be a boundary layer of gas, of thickness $\delta_k$, in which the thermal behavior can be approximated by saying that the temperature of the gas does not vary adiabatically, but rather assumes the temperature of the plate. That is, the gas in the boundary layer expands and contracts isothermally, whereas the gas outside the boundary layer expands and contracts adiabatically, as discussed above. This is to say that the heat capacity and heat conductivity of the plate are large enough that the temperature of the plate does not vary.

The heat flow $\dot{Q}$ into the plate can be represented by the equation:

$$\dot{Q} = \frac{dQ}{dt} = -ka \frac{dT}{dy}, \quad (31)$$

where dT/dy is the local temperature gradient away from the surface of the plate, a is the area of the plate, and k is the thermal conductivity coefficient of the gas.

If the conditions $\rho C_p \delta T = 0$ for $y = 0$ and $\rho C_p \delta T = \rho C_p \delta T_a \cos \omega t$ for large y are imposed, the equation of heat transfer in the limit of zero Prandtl number and zero longitudinal temperature gradient can be readily solved and represented as:

$$\rho C_p \delta T = \rho C_p \delta T_a \cos \omega t - \rho C_p \delta T_a e^{-y/\delta_\kappa} \cos (\omega t - y/\delta_\kappa) \quad (32).$$

where $\delta_\kappa$ is the thermal penetration depth in the gas and is defined as $\delta_\kappa \equiv (2\kappa/\omega)^{\frac{1}{2}}$, κ being the thermal diffusivity of the gas.

The term $\cos(\omega t - y/\delta_\kappa)$ in the above equation can be expanded to give the following:

$$\rho C_p \delta T = \rho C_p \delta T_a (\cos \omega t)(1 - e^{-y/\delta_\kappa} \cos y/\delta_\kappa) - \rho C_p \delta T_a (\sin \omega t) e^{-y/\delta_\kappa} \sin y/\delta_\kappa \quad (33).$$

Recalling that $\bar{\dot{H}} = \overline{\overline{\rho C_p \delta T v A}}$, where the double bars represent averaging over space as well as time, the value of $\bar{\dot{H}}$ can be determined. Noting that the time average of the product of the terms cos ωt and sin ωt is equal to zero, and that the time average of the term $\sin^2 \omega t$ is equal to $\frac{1}{2}$, the above equation can be reduced to:

$$\bar{\dot{H}} = (-\rho C_p \delta T_a)(-v_a)\ \overline{\sin^2 \omega t} \int_0^\infty \pi dy e^{-y/\delta_\kappa} \sin y/\delta_\kappa. \quad (34)$$

where π is the perimeter, or the distance around, the hypothetical plate introduced into the cylinder. That is, for a plate of width w and thickness d, $dA = \pi dy = (2w + 2d)dy$. This is also to say that π is, for more complicated geometries, the surface area per unit length of the second thermodynamic medium located in the cylinder.

The above equation reduces to:

$$\bar{\dot{H}} = (\tfrac{1}{4}) \rho C_p \delta T_a v_a \pi \delta_\kappa \quad (35).$$

and setting $\rho C_p \delta T_a = P_a$ gives:

$$\bar{\dot{H}} = (\tfrac{1}{4}) P_a v_a \pi \delta_\kappa \quad (36).$$

Figure 8:
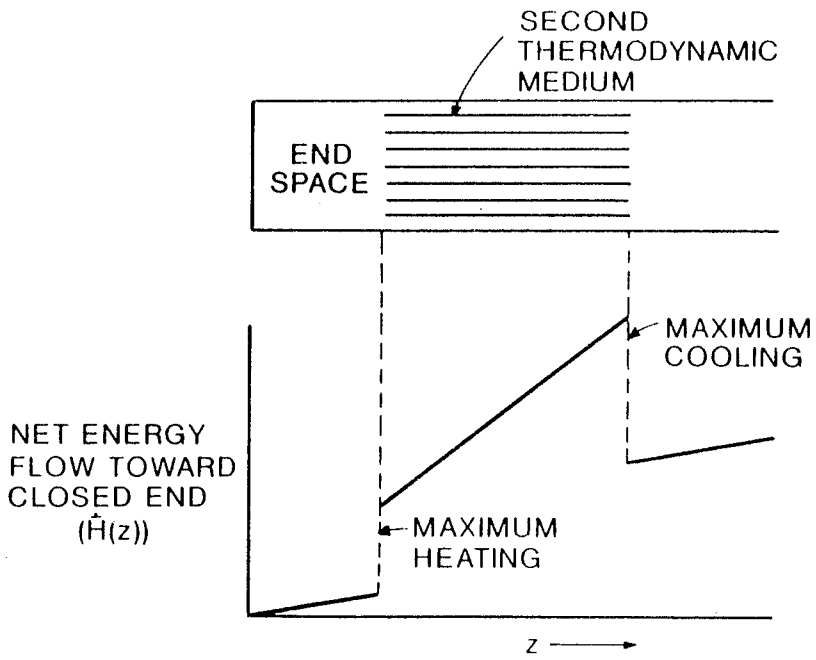
FIG. 8 is a schematic plot of energy flow $\bar{H}(z)$ as a function of position within an embodiment of the invention such as that shown in FIG. 5, taken immediately after the acoustical power has been turned on and before a temperature gradient has developed in the second medium.

Thus, it will be seen that the net energy flow $\bar{\dot{H}}$ in the gas along the cylinder depends on the total surface area per unit length of the cylinder and of any second thermodynamic medium contained in the cylinder. Since this quantity, represented by π, undergoes a discontinuity at the ends of a second thermodynamic medium of the type shown in FIGS. 1-5, the function $\bar{\dot{H}}(z)$ also undergoes a discontinuity at the ends of the medium. This is represented graphically in FIG. 8.

At the end of the medium closest to the closed end of the cylinder, the net energy flow $\dot{H}$ in the gas toward the closed end decreases discontinuously, so that by conservation of energy heat must be transferred to the second medium at this end, and the second medium gets hot.

Conversely, at the end closest to the drive means, energy flow in the gas increases in a discontinuous step function in going toward the closed end. Hence, heat must be removed from the second medium at this end.

Although $\pi$ changes discontinuously at either end of the second medium, $\bar{H}$ actually changes rapidly but continuously in these regions with a width of approximately the sum of $\delta_K$ and $x_a$ at the point in question.

It will further be noted from the above equation (36) that $\bar{H}$ steadily decreases toward the closed end of the cylinder, since the term $v_a$ steadily decreases toward zero at the closed end. Thus, there is a constant flow of heat into the walls of the cylinder at all points, but this flow of heat can be much smaller than the heat flow rates caused by the introduction of the second medium.

Figure 9:
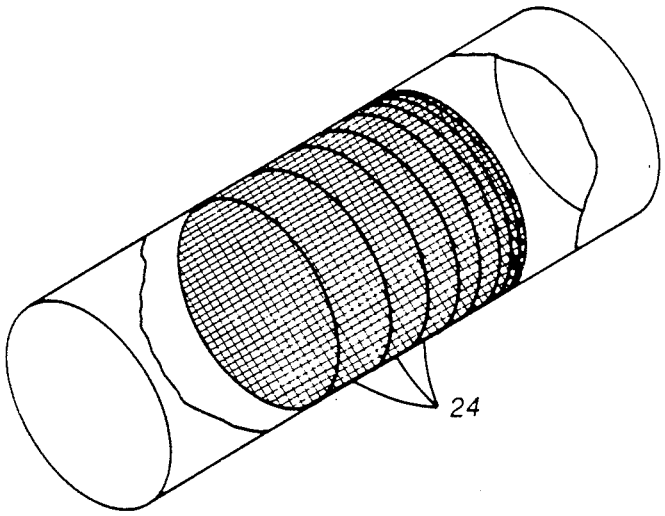
FIG. 9 is an isometric view of a second embodiment of the invention, wherein the second thermodynamic medium consists of a set of wire mesh screens.
Figure 10:
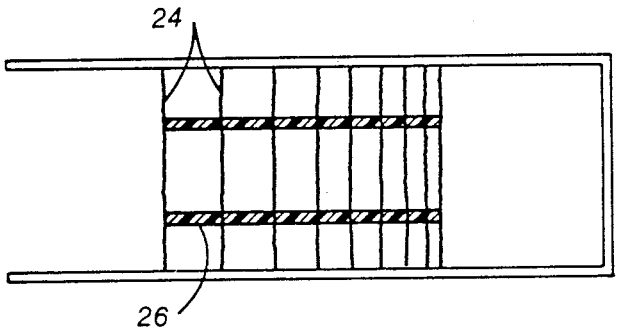
FIG. 10 is a side view of the embodiment shown in FIG. 9.

FIGS. 9 and 10 illustrate another embodiment of the invention wherein the second thermodynamic medium consists of a set of circular wire mesh screens 24. The screens are oriented perpendicular to the axis of the cylinder, and are held in position by small spacers 26.

It will be noted in FIGS. 9 and 10 that the spacing between the screens 24 varies progressively along the length of the cylinder. Specifically, the screens are spaced progressively more closely together toward the closed end of the cylinder. This feature is not a necessary element of the invention, but is illustrated to point out a principle of the invention. That principle is that the spacing between adjacent elements of the second thermodynamic medium, at any point along the cylinder, must be less than the double amplitude, or the reciprocal displacement, of the gas at that point. The performance will be impaired if the spacing is greater than the local reciprocal displacement of the gas. Since the reciprocal displacement of the gas progressively decreases toward the closed end of the cylinder, the maximum allowed spacing between elements of this type of second thermodynamic medium also decreases toward the closed end. This type of second medium may also be used with a uniform spacing, but then that spacing must be everywhere less than the minimum reciprocal displacement of the gas.

Figure 11:
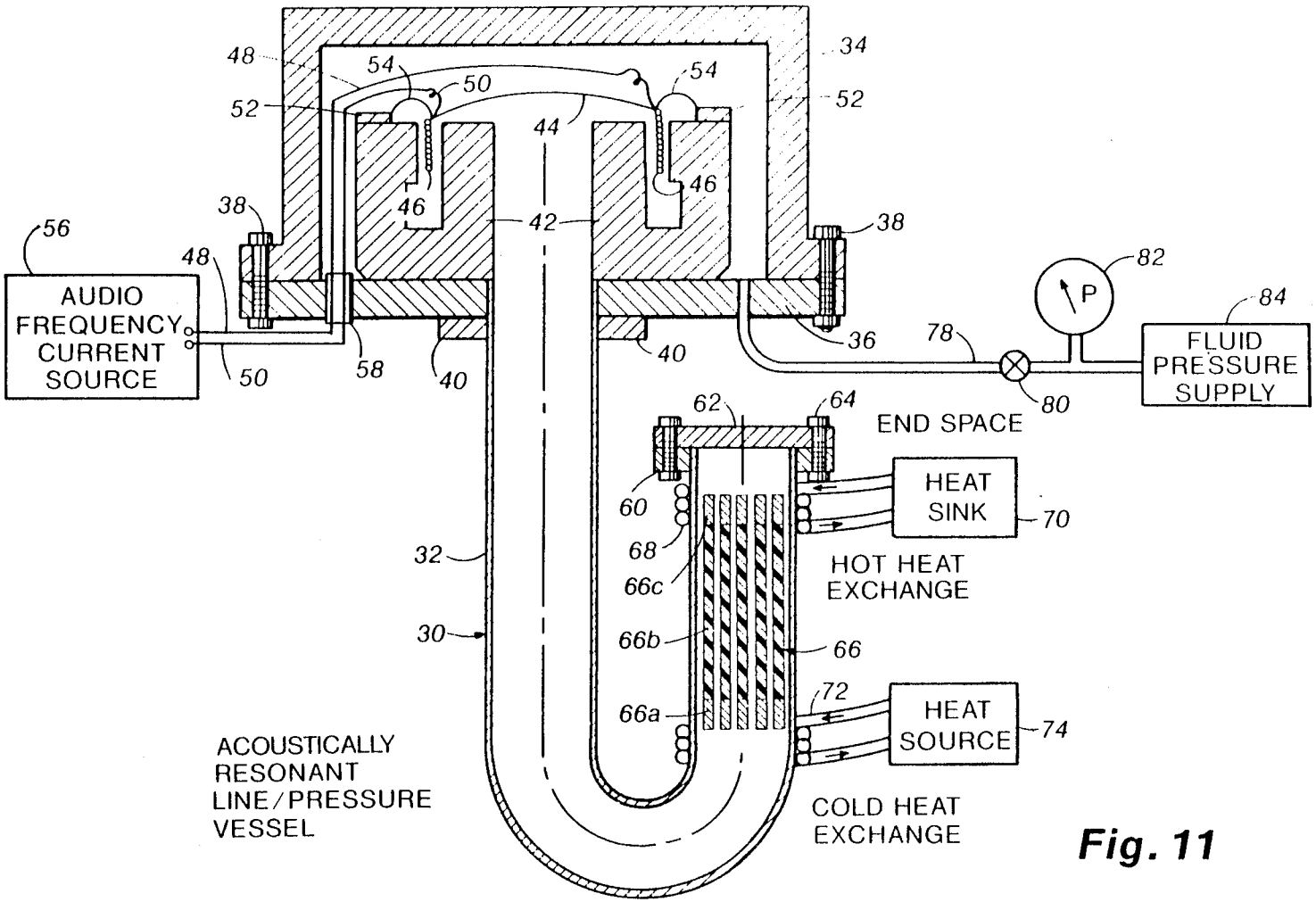
FIG. 11 is a cross sectional view of a preferred embodiment of an acoustically driven heat pump constructed in accordance with the invention.

A third and preferred embodiment of the invention is an acoustic heat pump 30, which is illustrated in FIG. 11 and which comprises a J-shaped, generally cylindrical or tubular housing 32 having a U-bend, a shorter stem and a longer stem. The longer stem is capped by an acoustical driver container 34 supported on a base plate 36 and mounted thereto by bolts 38 to form a pressurized fluid-tight seal between base plate 36 and container 34. The base plate 36 in the preferred embodiment sits atop a flange 40 extending outwardly from the wall of housing 32. The acoustical driver container 34 encloses a magnet 42, a diaphragm 44, and a voice coil 46. Wires 48 and 50 passing through a seal 58 in base plate 36 extend to an audio frequency current source 56. The voice coildiaphragm assembly is mounted by a flexible annulus 54 to a base 52 affixed to magnet 42. It will be appreciated by those skilled in the art that the acoustical driver illustrated is conventional in nature. In the preferred embodiment the driver operates in the 400 Hz range. However, in the preferred embodiment, from 100 to 1000 Hz may be used. In the preferred embodiment the vessel 32 was filled with helium, but again one skilled in the art will appreciate that other fluids, including gases such as air or hydrogen, or liquids such as freons, propylene, or liquid metals such as liquid sodium-potassium eutectic may readily be utilized to practice the invention. A flange 60 is affixed atop the shorter stem by, for example, welding it thereto. An end cap 62 is disposed atop flange 60 and is affixed thereto by bolts 64 to form a pressurized fluid-tight seal. A second thermodynamic medium 66, which in the preferred embodiment of FIG. 11 is similar to that shown in FIGS. 1–4, preferably comprises parallel plates 66*b* of a material such as Mylar, Nylon, Kapton, epoxy or fiberglass; and thermally conductive end sections 66*a* and 66*c* formed of copper, or other suitable material. The material used must be capable of heat exchange with the fluid within housing 32. Any solid substance for which the effective heat capacity per unit area at the frequency of operation is much greater than that of the adjacent fluid and which has an adequately low longitudinal thermal conductance will function as a second thermodynamic medium. It should be noted that there is an end space between end cap 62 and the top of thermodynamic medium 66. The housing 32 in the vicinity of the end space and the top of medium 66 communicate with a heat sink 70 via conduit 68, providing hot heat exchange. On the housing 32 at the lower end of the thermodynamic medium 66 a second conduit 72 communicates with a heat source 74 and provides a cold heat exchange.

A desired or selected pressure is provided through a conduit 78 and valve 80 from a fluid pressure supply 84. The pressure may be monitored by a pressure meter 82.

The acoustical driver assembly, having the permanent magnet 42 providing a radial magnetic field which acts on currents in the voice coil 46 to produce the force on the diaphragm 44 to drive acoustical oscillations within the fluid, is mechanically coupled to housing 32, a J-tube shaped acoustical resonator having one end closed by end cap 62. In a typical device the resonator may be nearly a quarter wavelength long at its fundamental resonance, but this is not crucial to the operation of the device. No mechanical inertial device is needed as any necessary inertia is provided by the primary fluid itself resonating within the J-tube. The second thermodynamic medium comprising layers 66 should have small longitudinal thermal conductivity in order to reduce heat loss. In the preferred embodiment the spacing between the plates of the medium 66 is a uniform distance d. Another requirement of the second medium is that its effective heat capacity per unit area $C_{A2}$ should be much greater than that, $C_{A1}$, of the adjacent primary medium. These qualities are represented mathematically as follows.

$$C_{A1} = c_1 \frac{d}{2} : C_{A2} = C_2\delta_2$$

where $C_1$ and $C_2$ are the heat capacities per unit volume, respectively, of the primary fluid medium and the second solid medium 66 and $\delta_2=(2\kappa_2/\omega)^{\frac{1}{2}}$, $\delta_2$ being the thermal penetration depth into the second medium of thermal diffusivity $\kappa_2$, at angular frequency $\omega=2\pi f$, where f is the acoustical frequency. The condition $C_{A2} >> C_{A1}$ is readily achieved, together with low longitudinal heat loss, if the second medium is a material like Kapton, Mylar, Nylon, epoxies or stainless steel for frequencies of a few hundred Hertz at a helium gas pressure of about 10 atm. For efficient operation, it is necessary that viscous losses be small. This can be achieved if $L/\lambda\!\!\!^{-} << 1$, where L is the length of the second medium and $\lambda$ is the radian length of the acoustical wave given by $\lambda\!\!\!^{-} = \lambda/2\pi = c/2\pi f$ where c is the velocity of sound in the fluid medium. In sizing the engine, one picks a reasonable L and then picks a general frequency from $L/\lambda\!\!\!^{-} << 1$. For an L of about 10 to 15 cm. a reasonable frequency is 300 to 400 Hz for helium near room temperature. The spacing d is then determined approximately by the requirement $\omega\tau_\kappa \sim$ needed to get the necessary temperature variations and the necessary phasing between temperature changes and primary fluid velocity. Here $\tau_\kappa$ is the diffusive thermal relaxation time given for a parallel plate geometry by $$\tau_\kappa = \frac{d^2}{\pi^2\kappa_1}.$$

there $\kappa_1$ is the thermal diffusivity of the primary fluid medium. For gases, $\kappa$ is very nearly inversely proportional to pressure. The spacing d is then determined approximately by the inequality $$d \gtrsim \frac{\pi^2\kappa_1}{\omega}^{\frac{1}{2}}.$$

A pressure of 10 atm with helium gas gives quite reasonable values for d, i.e., about 10 mils.

These considerations are typical in sizing the engine. Referring to FIG. 11, the operation as a heat pump or refrigerator is as follows. The acoustical driver is mounted in a vessel to withstand the working fluid pressure and is mechanically coupled in a fluid-tight way to the resonator, J-shaped tubing 32. Current leads from the voice coil are brought through seal 58 to an audio frequency current source 56. The acoustical system has been brought up to pressure p through valve 80 using fluid pressure supply 84. The frequency and amplitude of the audio frequency current source are selected to produce the fundamental resonance corresponding to approximately a quarter wave resonance in the J-shaped tube 32. A driver such as a JBL 375AB manufactured by James B. Lansing Sound, Inc. will readily produce in $^4$He gas a one atm peak to peak pressure variation at end cap 62 when the average pressure within the housing is about 10 atm and the diameter of the J-shaped tube 32 is one inch.

Since the length of the medium 66 is much less than $\lambda\!\!\!^{-}$, the pressure is nearly uniform over the second thermodynamic medium. The effects there are thus essentially the same as they would have been with an ordinary mechanical piston and cylinder arrangement producing the same pressure variation at this high frequency.

Heat pumping action is as follows. Consider a small increment of fluid near the second medium at an instant when the oscillatory pressure is zero and going positive. As pressure increases the increment of fluid moves toward the end cap 62 and warms as it moves. With a time delay $\tau_\kappa$, heat is transferred to the second medium 66 from the hot increment of fluid after the fluid has moved toward the end cap from its equilibrium position, thereby transferring heat toward the end cap. The pressure then decreases, and therewith, the temperature decreases. However, this temperature decrease is not communicated to the second medium until the same increment of fluid has moved a significant distance from its equilibrium position away from end cap 62 toward the U-bend, thereby transferring cold toward the U-bend. Within the second medium under initial conditions of zero temperature gradient the heating and cooling effects of nearby fluid particles nearly cancel, but at the end of the second medium near end cap 62 the cancellation does not occur and heating results. In a similar fashion the end of the second medium away from end cap 62 cools. Cooling at the bottom will continue until the temperature gradient and losses are such that as the fluid moves, the second medium temperature matches that of the adjacent moving fluid. Adjustment of the size of the end space below the end cap determines the volumetric displacement of the fluid at the end of the thermal lag space and hence plays an important role in determining the amount of heat pumped. Note that since the bottom is cold the J-tube arrangement shown is gravitationally stable with respect to natural convection of the primary fluid. If an apparatus in accordance with the invention is constructed to operate in a gravity-free environment, such as outer space, the J-shape of the tube will be unnecessary. The J-shape of the tube 32 can also be modified, as can its attitude, if some degradation of performance is acceptable. For example, straight and U-shaped tubes may be utilized.

The foregoing description of several embodiments of the invention has been presented for purposes of illustration and description. It is not intended to be exhaustive or to limit the invention to the precise forms disclosed, and obviously many modifications and variations are possible in light of the above teaching. The illustrated embodiments were chosen and described in order to best explain the principles of the invention and its practical application, to thereby enable others skilled in the art to best utilize the invention in various embodiments and with various modifications as are suited to the particular use contemplated. It is intended that the scope of the invention be defined by the claims appended hereto.

What is claimed is:

1. A heat engine comprising a first medium and a second medium in imperfect thermal contact with one another, said first medium being movable in reciprocal motion with respect to said second medium along a path of reciprocal motion, said reciprocal motion of said first medium being accompanied by a temperature change in said first medium such that the temperature of said first medium varies progressively as a function of its displacement with respect to said second medium, the average heat flow between said first and second mediums per unit length along said path of reciprocal motion increasing along said path of reciprocal motion in a first region and decreasing along said path of reciprocal motion in a second region, and wherein said second medium is of a length in the direction of said reciprocal motion which is substantially greater than the range of said reciprocal motion, whereby the heat engine is operable either as a heat pump, by driving said first medium in said reciprocal motion so as to produce a useful differential temperature distribution in said second medium, or as a prime mover, by inducing a differential temperature distribution in said second medium to thereby cause said first medium to move in cyclical reciprocal motion that may be applied to perform useful mechanical work.

2. A heat pump comprising a first medium and a second medium in imperfect thermal contact with one another, said first medium being movable in reciprocal motion with respect to said second medium along a path of reciprocal motion, said reciprocal motion of said first medium being accompanied by a temperature change in said first medium such that the temperature of said first medium varies progressively as a function of the displacement of said first medium with respect to said second medium, the average heat flow between said first and second mediums per unit length along said path of reciprocal motion increasing in a first region and decreasing in a second region, drive means coupled to said first medium for driving said first medium in reciprocal motion, and wherein said second medium is of a length in the direction of said reciprocal motion which is substantially greater than the range of said reciprocal motion, whereby driving of said first medium in said reciprocal motion results in production of a differential temperature distribution in said second medium.

3. The heat pump defined in claim 2 wherein said drive means is an acoustic driver and wherein said first medium is a fluid contained in a housing.

4. The heat pump defined in claim 2 wherein said drive means is an acoustic driver and wherein said first medium is a gas contained in a housing, with said second medium located in said housing in imperfect thermal contact with said gas, and further wherein said second medium comprises a structure having a low gas flow impedance in the direction of reciprocal motion of said gas and wherein said second medium has a heat capacity higher than the heat capacity of said gas.

5. The heat pump defined in claim 4 wherein said gas is driven by said acoustic driver at a resonant frequency.

6. The heat pump defined in claim 4 wherein said second thermodynamic medium comprises a plurality of elongate spaced apart plates oriented so as to extend parallel to the direction of reciprocal motion of said gas.

7. The heat pump defined in claim 6 wherein said gas is driven at an acoustic frequency that is approximately inversely related to the thermal relaxation time of said gas with respect to said second medium.

8. The heat pump defined in claim 6 further comprising heat sink means coupled to the ends of said second thermodynamic medium, whereby heat withdrawn from one end of said second medium results in a refrigeration effect at the opposite end of said second medium.

9. The heat pump defined in claim 8 wherein each of said plates comprises a pair of end sections formed of a first material of high thermal conductivity and an intermediate section formed of a material having a relatively low thermal conductivity.

10. The heat pump defined in claim 9 wherein said housing is a cylindrical tubular housing and wherein said heat sink means are in thermal contact with portions of said housing adjacent said end sections of said plates, and wherein said end sections of said plates are in thermal contact with said housing and wherein said intermediate sections are spaced from said housing.

11. The heat pump defined in claim 4 wherein said second thermodynamic medium comprises a plurality of substantially planar wire mesh screens each oriented so as to extend parallel to one another and transversely with respect to the direction of reciprocal motion of said gas, and wherein said wire screens are spaced from one another.

12. The heat pump defined in claim 4 wherein said first thermodynamic medium is gaseous helium contained at a pressure substantially above atmospheric pressure.

13. The heat pump defined in claim 4 wherein said second medium comprises a plurality of elements which each have a low impedance to fluid flow in the direction of reciprocal motion of said gas, and wherein said elements are spaced from one another in the direction of said reciprocal motion by approximately the distance of the local reciprocal displacement of said gas.

14. The heat pump defined in claim 6 wherein said housing is a substantially tubular, elongate housing closed at one end and wherein said acoustic driver is an electromagnetic acoustic driver located at the opposite end of said housing, and wherein said plurality of plates comprising said second thermodynamic medium is located between said driver and said closed end of said housing.

15. A prime mover comprising a first medium and a second medium in imperfect thermal contact with one another, said first medium being movable in reciprocal motion with respect to said second medium along a path of reciprocal motion, said reciprocal motion of said first medium being accompanied by a temperature change in said first medium such that the temperature of said first medium varies progressively as a function of the displacement of said first medium with respect to said second medium, the average heat flow between said first and second mediums per unit length along said path of reciprocal motion increasing in a first region and decreasing in a second region, said second medium being of a length in the direction of said reciprocal motion which is substantially greater than the range of said reciprocal motion, and means thermally connected to said second medium for inducing a differential temperature distribution in said second medium to thereby result in cyclical reciprocal motion that may be applied to perform useful mechanical work.

16. The prime mover defined in claim 15 wherein said first thermodynamic medium is a fluid contained in a housing and wherein said second thermodynamic medium is located in said housing in imperfect contact with said fluid.

17. The prime mover defined in claim 16 wherein said second thermodynamic medium is a structure having a low impedance to fluid flow in the direction of reciprocal motion of said fluid, and wherein said second thermodynamic medium has a substantial heat capacity relative to that of said fluid.

18. The prime mover defined in claim 17 wherein said second thermodynamic medium comprises a plurality of elongate spaced apart plates oriented to as to extend parallel to the direction of reciprocal motion of said fluid.

19. The prime mover defined in claim 18 wherein said fluid is differentially heated by said second medium so as to be driven at a resonant frequency that is approximately inversely related to the thermal relaxation time of said fluid with respect to said second medium.

20. The prime mover defined in claim 19 further comprising heat exchange means coupled to the ends of said second thermodynamic medium for differentially heating said second medium.

21. The prime mover defined in claim 20 wherein each of said plates comprises a pair of end sections formed of a first material of high thermal conductivity and an intermediate section formed of a material having a relatively low thermal conductivity.

22. The prime mover defined in claim 21 wherein said housing is a cylindrical tubular housing and wherein said heat exchange means are in thermal contact with portions of said housing adjacent said end sections of said plates, and wherein said end sections of said plates are in thermal contact with said housing and wherein said intermediate sections are spaced from said housing.

23. The prime mover defined in claim 16 wherein said first thermodynamic medium is a gas which is differentially heated by said second thermodynamic medium so as to be driven to oscillate in reciprocal motion at a resonant acoustic frequency.

24. The prime mover defined in claim 23 wherein said gas is helium contained at a pressure substantially above atmospheric pressure.

* * * * *